US009347754B1

(12) United States Patent
Cundiff et al.

(10) Patent No.: US 9,347,754 B1
(45) Date of Patent: May 24, 2016

(54) FUZE SHOCK TRANSFER SYSTEM

(71) Applicant: Raytheon Company, Waltham, MA (US)

(72) Inventors: Brandon J. Cundiff, Oro Valley, AZ (US); John J. Spilotro, Tucson, AZ (US); Wayne Y. Lee, Vail, AZ (US); Kim L. Christianson, Oro Valley, AZ (US); Thomas H. Bootes, Tucson, AZ (US); Jason M. Shire, Tucson, AZ (US); Jesse T. Waddell, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/537,934

(22) Filed: Nov. 11, 2014

(51) Int. Cl.
*F42B 3/103* (2006.01)
*F42C 19/08* (2006.01)
*F42D 1/04* (2006.01)

(52) U.S. Cl.
CPC ..... *F42C 19/08* (2013.01); *F42B 3/103* (2013.01); *F42D 1/043* (2013.01)

(58) Field of Classification Search
USPC ..... 102/275.9, 275.11, 275.12
See application file for complete search history.

(56) References Cited

U.S. PATENT DOCUMENTS

| | | | | |
|---|---|---|---|---|
| 2,822,756 | A | 2/1958 | Kuller et. al. | |
| 3,517,615 | A | 6/1970 | Jacobs | |
| 3,707,917 | A | 1/1973 | Zernow et al. | |
| 4,938,141 | A * | 7/1990 | Gallant | 102/275.4 |
| 5,022,148 | A * | 6/1991 | Feldstein et al. | 29/890.031 |
| 5,182,417 | A * | 1/1993 | Rontey et al. | 102/204 |
| 2002/0096080 | A1 | 7/2002 | Lecume | |

FOREIGN PATENT DOCUMENTS

| | | |
|---|---|---|
| EP | 1225416 A1 | 7/2002 |
| EP | 0383658 A1 | 8/2009 |

* cited by examiner

*Primary Examiner* — Stephen M Johnson
(74) *Attorney, Agent, or Firm* — Renner, Otto, Boisselle & Sklar

(57) ABSTRACT

A munition has a fuze that is mounted nonparallel to the axis of the munition, for example having a largest extent that is perpendicular to the longitudinal axis of the munition. Shocks from the fuze are transferred through a shock transfer device that is in contact with the fuze, to an initiation device that is also in contact with the shock transfer device. Shocks passing through the shock transfer device to the initiation coupler pass through a relatively narrow neck of the shock transfer device. In the shock transfer device the shock is concentrated and located precisely at the neck, before spreading out again and being transferred to the initiation device. In the initiation device the shock may detonate a high explosive material, which in turn is used to detonate a main explosive of the munition, such as a warhead.

19 Claims, 3 Drawing Sheets

FUZE SHOCK TRANSFER SYSTEM

FIELD OF THE INVENTION

The invention is in the field of fuzed detonation systems for munitions, and munitions with such detonation systems.

DESCRIPTION OF THE RELATED ART

Munitions, such as bombs and missiles, often have explosives that are detonated through use of fuzes. One example is a height-of-burst munition, which is detonated at some desired height above ground.

SUMMARY OF THE INVENTION

One drawback to use of fuzes is that a fuze takes up space within the munition (like every other component of the munition). In particular, fuzes are generally longitudinally oriented within the munition, with the fuze for example being cylindrical, and with the longitudinal axis of the fuze being parallel to the longitudinal axis of the munition. Space along the longitudinal axis is often precious in configuring the munition, since the munition may have one or more larger-diameter components arranged longitudinally, such as an explosive charge and/or a penetrator, for example. Accordingly it may be desirable to place the fuze within the munition such that the fuze takes up less space in the longitudinal direction, relative to conventional fuze mountings with the fuze parallel to the longitudinal axis.

According to an aspect of the invention, a fuze is mounted such that its largest extent, such as the height of a cylindrical fuze, is not parallel to the axis of the munition. The largest extent of the fuze may be perpendicular to the longitudinal axis of the munition, for example.

According to an aspect of the invention, a fuze is coupled to a shock transfer device to transport a shock from the fuze to an initiation device. The shock transfer device includes a relatively narrow neck having a smaller cross-sectional area than a contact area between the shock transfer device and the fuze. The cross-sectional area of the neck may also be smaller than a contact area between the shock transfer device and the initiation device.

According to another aspect of the invention, a munition includes: a fuze, wherein the fuze has a longest extent that is nonparallel to a longitudinal axis of the munition; a shock transfer device in contact with an external surface of the fuze; and an initiation coupler. The initiation coupler receives a shock from the fuze, through the shock transfer device.

According to yet another aspect of the invention, a munition includes: a fuze; a shock transfer device in contact with an external surface of the fuze; and an initiation coupler. The initiation coupler receives a shock from the fuze, through the shock transfer device. The shock transfer device has relatively narrow neck that the shock traverses in going from the fuze to the initiation coupler, with the neck having a cross-sectional area that is less than a contact area between the shock transfer device and the fuze.

According to an embodiment of the device of any prior paragraph, the fuze includes a fuze casing with which the shock transfer device is in contact.

According to an embodiment of the device of any prior paragraph, the device includes a frame that clamps the fuze within the munition; and an impedance of the shock transfer device to shocks passing therethrough is greater than an impedance of the frame to shocks passing therethrough.

According to an embodiment of the device of any prior paragraph, the fuze casing and the shock transfer device are metallic, and the frame is nonmetallic.

According to an embodiment of the device of any prior paragraph, the fuze casing and the shock transfer device are made of the same material.

According to an embodiment of the device of any prior paragraph, the fuze casing has a curved outer surface.

According to an embodiment of the device of any prior paragraph, the shock transfer device has a curved surface that is in contact with part of the curved outer surface of the fuze.

According to an embodiment of the device of any prior paragraph, the fuze is cylindrical.

According to an embodiment of the device of any prior paragraph, the fuze includes a booster within the casing, and a detonator within the booster.

According to an embodiment of the device of any prior paragraph, the booster has an annular shape, with the detonator farther from the shock transfer device than a central hole within the booster.

According to an embodiment of the device of any prior paragraph, the shock transfer device has relatively narrow neck that the shock traverses in going from the fuze to the initiation coupler, with the neck having a cross-sectional area that is less than a contact area between the shock transfer device and the fuze.

According to an embodiment of the device of any prior paragraph, the cross-sectional area of the neck is less than a contact area between the shock transfer device and the initiation coupler.

According to an embodiment of the device of any prior paragraph, the initiation coupler contains an explosive that is detonated by a shock passing from the fuse, through the shock transfer device, to the initiation coupler.

According to an embodiment of the device of any prior paragraph, the device includes a warhead; and the explosive of the initiation coupler is operatively coupled to the warhead, to detonate the warhead.

According to an embodiment of the device of any prior paragraph, the fuze is perpendicular to the longitudinal axis of the munition.

According to an embodiment of the device of any prior paragraph, the munition is a bomb or missile.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A munition has a fuze that is mounted nonparallel to the axis of the munition, for example having a largest extent that is perpendicular to the longitudinal axis of the munition. Shocks from the fuze are transferred through a shock transfer device that is in contact with the fuze, to an initiation device that is also in contact with the shock transfer device. Shocks passing through the shock transfer device to the initiation coupler pass through a relatively narrow neck of the shock transfer device. The neck has a smaller cross-sectional area than both the contact area between the shock transfer device and the fuze, and area of the shock transfer device where it contacts the initiation device. In operation, a shock is created in the fuze, which propagates to the shock transfer device through contact between the fuze and the shock transfer device. In the shock transfer device the shock is concentrated and located precisely at the neck, before spreading out again and being transferred to the initiation device. In the initiation device the shock may detonate a high explosive material, which in turn is used to detonate a main explosive of the munition, such as a warhead. Materials of the shock transfer device may be selected to match impedance of the fuze, for good shock transfer between the two parts, and for transfer of the shock through the shock transfer device in preference to (faster than) transfer through other parts of the structure. For example the shock transfer device may be made of a suitable metal, and a frame that houses the fuze may be made of a suitable nonmetal.

Figure 1:
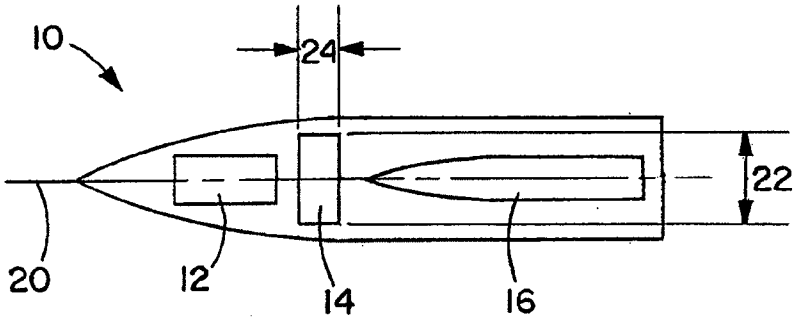
FIG. 1 is a schematic side view of a munition, according to an embodiment of the present invention.

Referring initially to FIG. 1, a munition 10, such as a bomb or a missile, has an explosive warhead 12 that is initiated by a fuze 14. The munition 10 also has a penetrator 16 aft of the warhead 12 and the fuze 14. The penetrator 16 of the illustrated embodiment is representative of any of variety of payloads that might take up some of the interior volume of the munition 10, and that in particular may stretch along a length of the munition 10, the extent of the munition 10 along its longitudinal axis 20. Other components alternatively or additionally may require portions of the length of the munition 10 for their layout. Such other components may be one or more of fragments, propulsion systems such as rocket engines, other explosives, sensors, communication systems, controllers for guidance systems, guidance electronic units, and power supplies such as batteries, to give a few (non-limiting) examples.

The fuze 14 may have a cylindrical shape with a height 22 and a diameter 24. The height 22 may be significantly greater than the diameter 24, thereby making the height 22 the greatest extent of the fuze 14. For example the height 22 may be about three times the diameter 24. The fuze 14 may be an off-the-shelf fuze that has already been tested and approved for use, and that has been and is used in a variety of systems. An example of such a fuze is the FMU-152 Fuze, available from Kaman Aerospace.

The warhead 12 and the penetrator 16 (and/or additional payload components) may be required to be oriented along the longitudinal axis 20 of the munition 10. As a result the distance along the longitudinal axis 20 may be at a premium when configuring the munition 10. Rather than locating the fuze 14 such that its greatest extent (e.g., the height 22) runs along the length of the munition 10 (along or parallel to the longitudinal axis 20), the fuze 14 may be located nonparallel to the longitudinal axis 20. In the illustrated embodiment the fuze 14 is shown as perpendicular to the longitudinal axis 20, an orientation that takes up the minimum length within the munition 10. However the fuze 14 may be located at other angles relative to the longitudinal axis 20, for example being located at an angle of between 45 degrees and 90 degrees (perpendicular) to the longitudinal axis 20.

Figure 2:
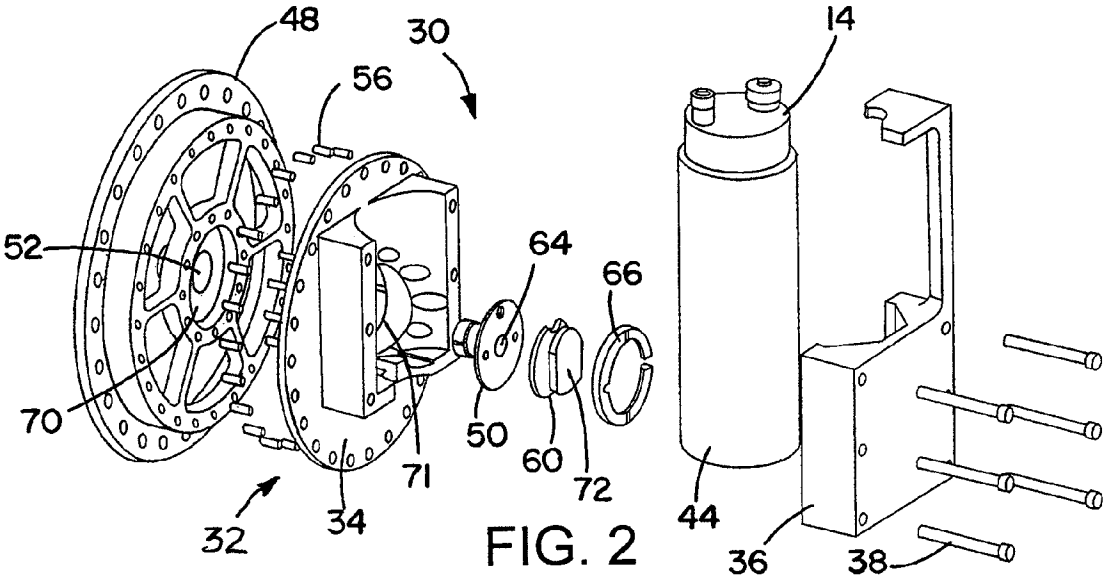
FIG. 2 is an exploded view of a fuze mounting of the munition of FIG. 1.

FIG. 2 shows components of a fuze mounting 30 that is used to mount the fuze 14, and to transfer force (a shock) from the fuze 14, to detonate an explosive, such as the explosive warhead 12 (FIG. 1). The fuze 14 is clamped within a frame 32, consisting of a base plate 34 and a top support 36, which are held together by a series of screws 38. The base plate 34 and the top support 36 together define a cylindrical pocket for receiving the fuze 14. The screws 38 are tightened to bear curved inner surfaces of the plate 34 and the support 36 against a cylindrical outer surface 44 of the fuze 14, holding the fuze 14 in the cylindrical pocket.

The base plate 34 covers a housing 48 that holds a precision initiation coupler 50 in a central opening 52 of the housing 48. The base plate 34 is held to the housing 48 by a series of screws 56. The warhead 12 (FIG. 1) is on the opposite side of the housing 48 from the base plate 34.

A shock transfer device 60 is in contact with both the fuze 14 and the precision initiation coupler 50. The shock transfer device 60 is used to transfer a shock from the fuze 14 to initiation coupler 50, to detonate a high explosive 64 that is in the initiation coupler 50. The high explosive 64 in turn detonates the explosive warhead 12 (FIG. 1). A retaining ring 66 is used to hold the initiation coupler 50 and the shock transfer device 60 against the housing 48. The retaining ring 66 fits into and engages the periphery of a recess 70 in the housing 48 that is around the central opening 52.

Figure 3:
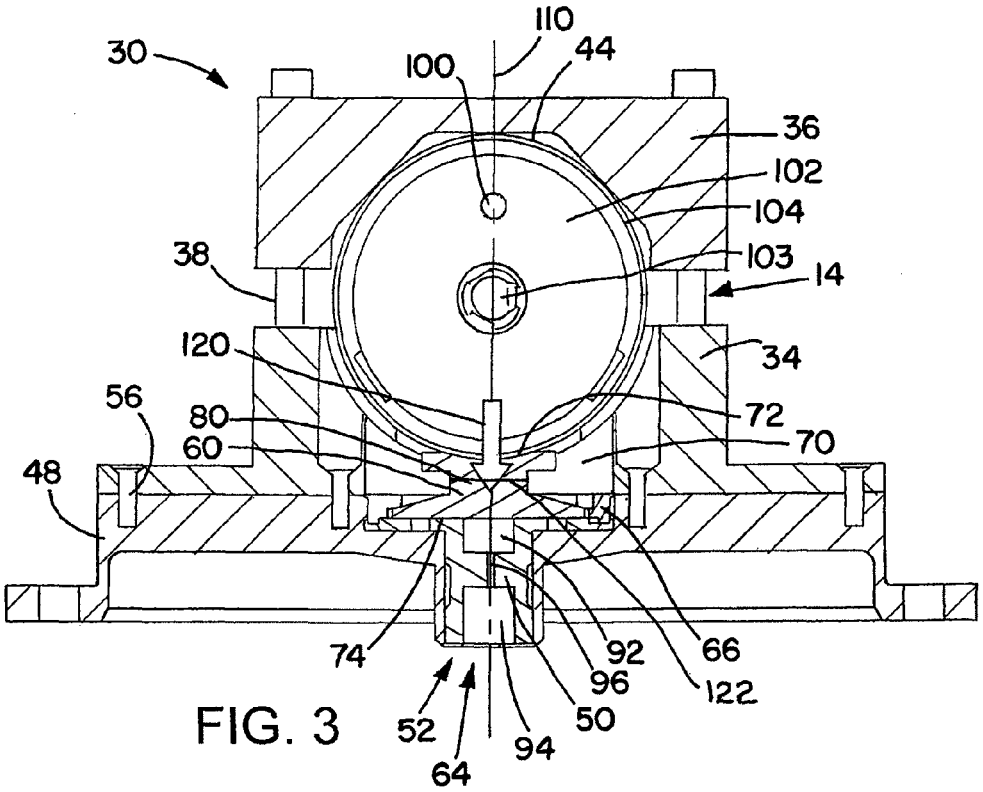
FIG. 3 is cross-sectional view of the fuze mounting of FIG. 2.

With reference now in addition to FIG. 3, the shock transfer device 60 reaches the fuze 14 by extending through an opening 71 in the bottom plate 34. The shock transfer device 60 has a curved fuze-engaging surface 72 that presses against the cylindrical outer surface 44 of the fuze 14. On an opposite end the device 60 has a flat initiation-coupler surface 74 that presses against initiation coupler 50. Between the contact surfaces 72 and 74 at the opposite ends of the device 60, the shock transfer device 60 has a neck 80. The neck 80 is relatively narrow, in that it has a cross-sectional area that is less than the cross-sectional areas above and below the neck 80, out toward the ends of the shock transfer device 60. The cross-sectional area at the neck 80 is also less than the contact areas at both of the contact surfaces 72 and 74.

The area of the input contact surface 72 may be greater than the area of the output contact surface 74. To give example values, the contact surface 72 may have an area that is at least 1.5 times the area of the contact surface 74, or more narrowly may be from 1.5 times to 2 times the area of the contact surface 74.

As noted above, the initiation coupler 50 has a high explosive 64 that is detonated by a shock by a shock received through the device 60. The high explosive 64 includes a relatively-broad upper portion (acceptor) 92 and a relatively-broad lower portion 94, which are linked together by an explosive-filled transfer tube 96.

As illustrated, the area of the output surface 74 may be greater than the area of the acceptor 92. To give example values, the area of the output surface 74 may be at least twice the area of the acceptor 92 that is in contact with the output surface 74.

In operation, a detonator 100 of the fuze 14 is initiated, such as by an electrical signal from a controller (not shown). The detonator 100 initiates a shock wave that causes detonation in a booster 102 of the fuze 14. The detonation of the booster 102 enhances the strength of the shock that propagates through the booster 102. The booster 102 may be made out of a suitable material for performing these functions, such as any of a variety of common explosives. In the illustrated embodiment the booster 102 has an annular shape, with a central hole 103 in the material of the booster 102, and with the outside of the booster 102 surrounded by a fuze casing 104 of the fuze 14. The detonator 100 may be located asymmetrically (non-axisymmetrically) within the booster 102, away from the central hole 103 in the middle of the booster 102. In the illustrated embodiment detonator 100 is located on the side of the booster 102 that is farthest away from the shock transfer device 60. The detonator 100 may be centered relative to the device 60, such that a central axis 110 of the device 60 passes through the detonator 100. This configuration allows creation of a Mach stem, where shocks passing through the booster 102 on opposite sides of the central hole 103, and then recombine and reinforce one another on the lower end of the booster 102 as shown in FIG. 3, the side of the booster 102 that is diametrically opposed from the detonator 100. This provides greater shock strength to the portion of the fuze casing 104 that is in contact with the shock transfer device 60. However, the detonator 100 and the booster 102 may have a configuration that is different from that shown in the illustrated embodiment.

After the shock is generated and segmented inside the fuze 14, the shock passes from the fuze casing 104 to the shock transfer device 60, as shown at reference number 120. Reference number 120 shows the direction that the shock traverses in going from the fuze 14 to the initiation coupler 50. The narrow neck 80 has a cross-sectional area 122, perpendicular to the direction that the shock traverses through the neck 80 in going from the fuze 14 to the initiation coupler 50 (the direction shown by reference number 120), that is less than a contact area between the shock transfer device 60 and the fuze 14. Many shock transfer paths through the fuze mounting 30 are possible, but the path from the fuze casing 104 to the shock transfer device 60 represents the path where the shock travels the fastest, because of the materials used in various parts of the fuze mounting 30. The shock transfer device 60 may be made of metal, and may be made of the same metal as the fuze casing 104, for example with both being made of stainless steel. Other parts of the fuze mounting 30, such as the frame 32 and the retaining ring 66, may be made of non-metallic materials, for example any of a variety of plastic polymer materials such as nylon. The shock transfer through the metal parts proceeds much faster than through the non-metal parts. In addition, shock transfer paths that pass at least in part through air proceed more slowly than transfer through metal parts, such as from the fuze casing 104 directly to the shock transfer device 60. Therefore the direct transfer of shock from the fuze casing 104 to the shock transfer device 60 is the primary mechanism that leads to detonation of the high explosive 64, which leads eventually to the detonation of the warhead 12 (FIG. 1). Other possible paths for the shock are slower, and can be neglected in considering the mechanism of detonation.

As the shock proceeds from top to bottom in FIG. 3 through the device 60, it passes through the neck 80. The travel through the neck 80 separates out the shock into two portions, a faster-travelling shock that passes through the metal of the neck 80, and a slower-traveling shock that passes through the air gap between the wider upper and lower portions of the device 60. Only the faster shock through the lower impedance metal plays a part in the detonation process, so the passage through the neck 80 focuses the shock there. After passage through the neck 80, the shock spreads out in the lower part of the device 60, the part that includes the surface 74 that makes contact with the initiation coupler 50. Once the shock reaches the initiation coupler 50, it sets off the upper portion explosive 92, which causes propagation of the detonation through the transfer tube 96 to the lower portion 94, and from there to the warhead 12 (FIG. 1).

The widening after passing through the narrow neck 80 allows the shock to continue to propagate through a similar material, reducing the effect of any pressure wave through the air. As an alternative, there may be no widening after the narrowing to a neck for certain geometries, such as if the neck had a height that was much less than the overall length of the shock transfer device.

The combination of the geometry of fuze mounting 30, along with the different impedances of the materials involved, combine to direct the shock from the fuze 14 to where it is best employed for initiation of the warhead 12 (FIG. 1). The arrangement of parts allows the fuze 14 to be arranged other than parallel to the longitudinal axis 20 (FIG. 1) of the munition 10 (FIG. 1).

Many variations in terms of materials are possible. The nonmetal parts of the fuze mounting 30 may be made of any of a variety of other rigid nonmetal materials, such as polystyrene foam, rubber, plastic, wood, or composite materials. The shock transfer device 60 may be made of any of a variety of metal materials, which may or may not match with the material of the fuze casing 104. The initiation coupler 50 may be made of aluminum or another suitable material. Since the shock does not pass through the initiation coupler 50, but rather is used to detonate the explosive 64 that is in the coupler 50, the material of the initiation coupler 50 may be less important to the performance of the system.

The munition 10 may be any of a variety of munitions, such as missile or bomb. Alternatively, the fuze mounting 30 may be part of an explosive train for detonation in other types of devices.

The figures and description above relate to only one of many possible ways that the fuze system of the munition, and its parts, may be configured and arranged. The shock transfer device 60 may have any of a wide variety of other configurations, for example varying the relative dimensions of the device 60 and/or the shape of the device 60. As one example, it may be possible to configure the device 60 without the relatively narrow neck 80 that is described above. For mountings of the fuze at an oblique angle to a longitudinal munition axis, the shock transfer device 60 may be modified such that its contact surfaces are at appropriate angles for making contact with the fuze and the initiation coupler. Also, while a cylindrical fuze is shown, it will be appreciated that alternatively the fuze may have another shape and/or other relative dimensions.

Figure 4:
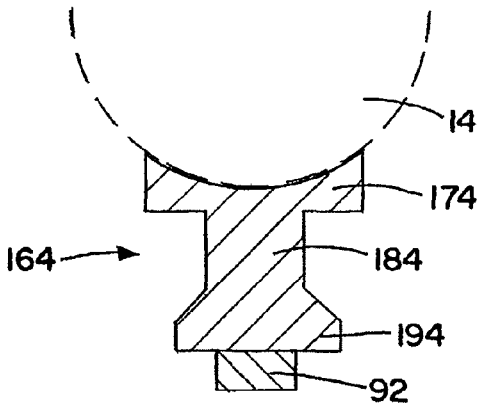
FIG. 4 is a cross-sectional view of a first alternate embodiment shock transfer device.

FIGS. 4-10 show a few of the many alternative configurations that are possible for the shock transfer device 60, in transferring shock from the fuze 14 to the acceptor 92. FIG. 4 shows a shock transfer device 164 that has a top portion 174, in contact with the fuze 14, and that makes a stepwise transition to a narrow neck 184. The device 164 also has a bottom portion 194, in contact with the acceptor 92, that tapers outward from the neck 184 with a constant slope. The height of the neck 184, which may have a constant cross-sectional area over the height, may be greater than the height of the top portion 174 and/or the bottom portion 194.

Figure 5:
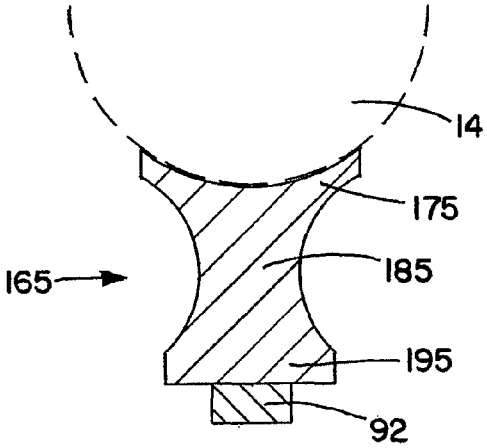
FIG. 5 is a cross-sectional view of a second alternate embodiment shock transfer device.

FIG. 5 shows a shock transfer device 165 that has a diameter that varies continuously over its height from a top portion 175 to a bottom portion 195, with a minimal diameter being located at a narrow neck 185. The device 165 has a nonlinear continuous variation in diameter from the top portion 175 to the bottom portion 195.

Figure 6:
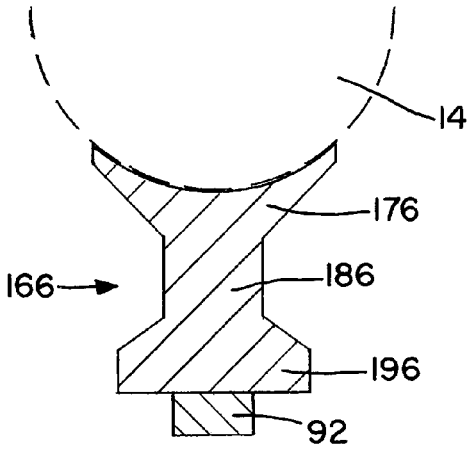
FIG. 6 is a cross-sectional view of a third alternate embodiment shock transfer device.

FIG. 6 shows a shock transfer device 166 that has a top portion 176 and a bottom portion 196 that transition to a narrow neck 186 by linear changes in diameter. The narrow neck 186 has a constant-diameter portion that has a height that may be greater than, less than, or about the same as the heights of the top portion 176 and the bottom portion 196 (including the transition parts with the linear change in diameter).

Figure 7:
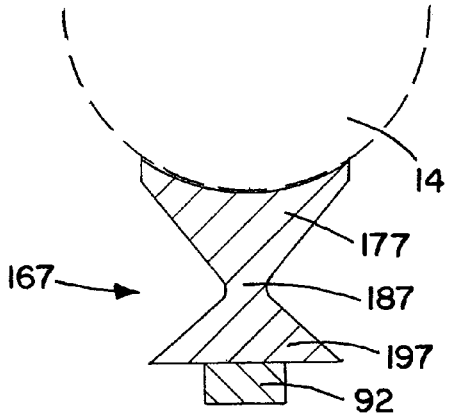
FIG. 7 is a cross-sectional view of a fourth alternate embodiment shock transfer device.

FIG. 7 shows a shock transfer device 167 that has a top portion 177 and a bottom portion 197 that have linear changes in diameter as the top portion 177 and the bottom portion 197 transition to a narrow neck 187. The neck 187 has small height, being curved to change over a small height from the transition to the top portion 177 to the transition to the bottom portion 197.

Figure 8:
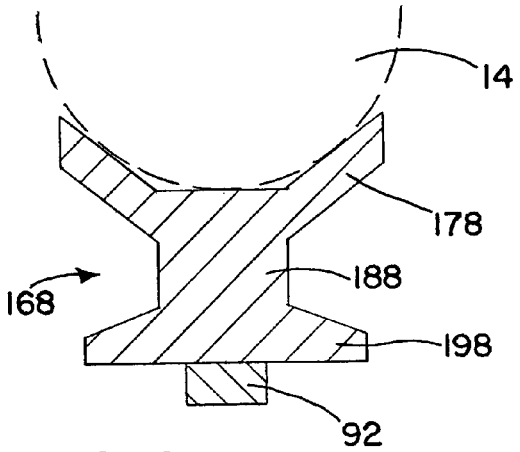
FIG. 8 is a cross-sectional view of a fifth alternate embodiment shock transfer device.

FIG. 8 shows another embodiment, a shock transfer device 168 that transitions with linearly-reducing diameter from a top portion 178 to a narrow neck 188 that has a constant diameter, and then from the neck 180 transitions with linearly-increasing diameter to a bottom portion 198. The areas available for contact with the top portion 178 and the bottom portion 198 may both be much greater than the cross-sectional area of the neck 188.

Figure 9:
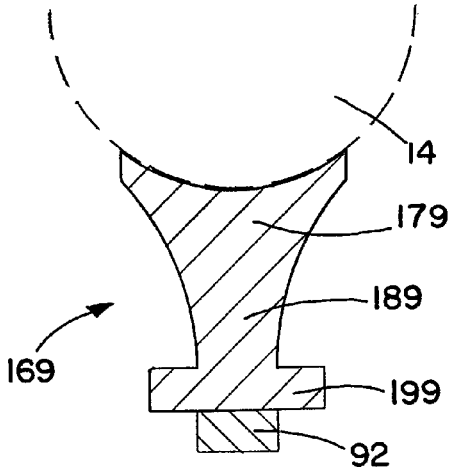
FIG. 9 is a cross-sectional view of a sixth alternate embodiment shock transfer device.

FIG. 9 shows a shock transfer device 169 in which the neck 189 is a long (tall) curved transition down from a top portion 179. The neck 189 reaches a minimum diameter at its bottom, right before a stepwise increase in diameter to a bottom portion 199. The top portion 179 and the neck 189 together are much longer (higher) than the bottom portion 199.

Figure 10:
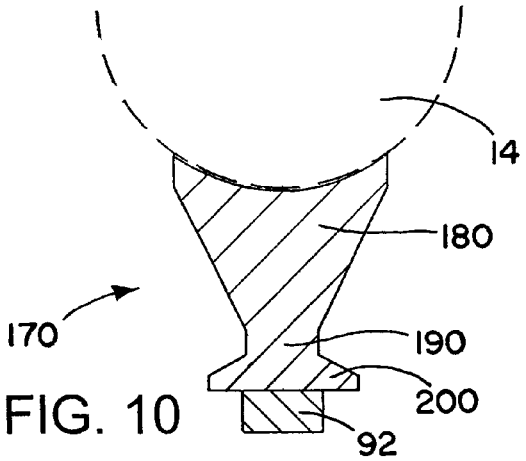
FIG. 10 is a cross-sectional view of a seventh alternate embodiment shock transfer device.

FIG. 10 shows a shock transfer device 170 in which the neck 190 has a constant diameter, reached after a long (tall) linear transition down from a top portion 180. The neck 190 has a short constant-diameter portion, and then transitions to a linear increase in diameter, over a short height, to a bottom portion 200. Similar to the device 169 (FIG. 9), the top portion 180 and the neck 190 together are much longer (higher) than the bottom portion 200.

As the various embodiments shown herein illustrate, the cross-sectional area of the necks may be greater than, less than, or about the same as the area of the acceptor 92 or the contact area between the acceptor 92 and the various bottom portions. The illustrated embodiments are only a few of many possible usable shapes. More generally, the shock transfer device has edges that transition the input surface (for receiving a shock from the fuze) down to narrow neck, and then back out to the output surface (for making contact with the acceptor). The transition may be continuous or discontinuous, and a continuous transition may be linear or nonlinear.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A munition comprising:

a fuze, wherein the fuze has a longest extent in a direction that is nonparallel to a longitudinal axis of the munition;

a shock transfer device in contact with an external surface of the fuze; and an initiation coupler;

wherein the initiation coupler receives a shock from the fuze, through the shock transfer device;

wherein the fuze includes a fuze casing with which the shock transfer device is in contact;

further comprising a frame that clamps the fuze within the munition; and wherein an impedance of the shock transfer device to shocks passing therethrough is greater than an impedance of the frame to shocks passing therethrough.

2. The munition of claim 1, wherein the fuze casing and the shock transfer device are metallic, and the frame is nonmetallic.

3. A munition comprising:

a fuze, wherein the fuze has a longest extent in a direction that is nonparallel to a longitudinal axis of the munition;

a shock transfer device in contact with an external surface of the fuze; and an initiation coupler;

wherein the initiation coupler receives a shock from the fuze, through the shock transfer device;

wherein the fuze includes a fuze casing with which the shock transfer device is in contact;

wherein the fuze includes a booster within the casing, and a detonator within the booster; and wherein the booster has an annular shape, with the detonator farther from the shock transfer device than a central hole within the booster.

4. A munition comprising:

a fuze, wherein the fuze has a longest extent in a direction that is nonparallel to a longitudinal axis of the munition;

a shock transfer device in contact with an external surface of the fuze; and an initiation coupler;

wherein the initiation coupler receives a shock from the fuze, through the shock transfer device; and wherein the shock transfer device has relatively narrow neck that the shock traverses in going from the fuze to the initiation coupler, with the neck having a cross-sectional area, perpendicular to a direction that the shock traverses through the neck in going from the fuze to the initiation coupler, that is less than a contact area between the shock transfer device and the fuze.

5. The munition of claim 4, wherein the fuze includes a fuze casing with which the shock transfer device is in contact.

6. The munition of claim 5, wherein the fuze casing has a curved outer surface; and wherein the shock transfer device has a curved surface that is in contact with part of the curved outer surface of the fuze.

7. The munition of claim 6, wherein the fuze is cylindrical.

8. The munition of claim 5, wherein the fuze includes a booster within the casing, and a detonator within the booster.

9. The munition of claim 5, wherein the fuze casing and the shock transfer device are made of the same material.

10. The munition of claim 4, wherein the cross-sectional area of the neck is less than a contact area between the shock transfer device and the initiation coupler.

11. The munition of claim 4, wherein the initiation coupler contains an explosive that is detonated by a shock passing from the fuse, through the shock transfer device, to the initiation coupler.

12. The munition of claim 11, further comprising a warhead; and wherein the explosive of the initiation coupler is operatively coupled to the warhead, to detonate the warhead.

13. The munition of claim 4, wherein the direction of the longest extent of the fuze is perpendicular to the longitudinal axis of the munition.

14. The munition of claim 4, wherein the munition is a bomb or missile.

15. A munition comprising:

a fuze;

a shock transfer device in contact with an external surface of the fuze; and an initiation coupler;

wherein the initiation coupler receives a shock from the fuze, through the shock transfer device; and wherein the shock transfer device has relatively narrow neck that the shock traverses in going from the fuze to the initiation coupler, with the neck having a cross-sectional area, perpendicular to a direction that the shock traverses through the neck in going from the fuze to the initiation coupler, that is less than a contact area between the shock transfer device and the fuze.

16. The munition of claim 15, wherein the cross-sectional area of the neck is less than a contact area between the shock transfer device and the initiation coupler.

17. The munition of claim 15, further comprising a frame that clamps the fuze within the munition;

wherein the fuze includes a fuze casing with which the shock transfer device is in contact;

wherein an impedance of the shock transfer device to shocks passing therethrough that is greater than an impedance of the frame to shocks passing therethrough; and wherein the fuze casing and the shock transfer device are metallic, and the frame is nonmetallic.

18. The munition of claim 17, wherein the fuze includes a booster within the casing, and a detonator within the booster; and wherein the booster has an annular shape, with the detonator farther from the shock transfer device than a central hole within the booster.

19. The munition of claim 15, wherein the fuze has a longest extent that is in a direction that is perpendicular to a longitudinal axis of the munition.

* * * * *